US006083088A

United States Patent [19]

Hepworth

[11] Patent Number: 6,083,088

[45] Date of Patent: Jul. 4, 2000

[54] IMPLEMENT WORKING ADAPTER

[75] Inventor: Paul Steabben Hepworth, Guildford, United Kingdom

[73] Assignee: Turner Intellectual Property Limited, United Kingdom

[21] Appl. No.: 09/029,454

[22] PCT Filed: Aug. 23, 1996

[86] PCT No.: PCT/GB96/02071

§ 371 Date: Feb. 26, 1998

§ 102(e) Date: Feb. 26, 1998

[87] PCT Pub. No.: WO97/07932

PCT Pub. Date: Mar. 6, 1997

[51] Int. Cl.[7] ..... B24B 7/00

[52] U.S. Cl. ..... 451/198; 451/419

[58] Field of Search ..... 451/45, 194, 198, 451/192, 193, 234, 419, 420, 232, 321, 371, 380, 387

[56] References Cited

U.S. PATENT DOCUMENTS

| | | | |
|---|---|---|---|
| 2,799,125 | 7/1957 | Dicke | 51/80 |
| 2,853,053 | 9/1958 | Hamilton | 120/96 |
| 2,865,141 | 12/1958 | Madl et al. | 51/80 |
| 3,258,878 | 7/1966 | Clark . | |
| 3,811,226 | 5/1974 | Gangelhoff et al. | 51/80 R |
| 4,069,619 | 1/1978 | Escamilla . | |
| 5,189,848 | 3/1993 | Flaherty | 51/285 |
| 5,245,789 | 9/1993 | Rees et al. | 51/80 BS |
| 5,611,726 | 3/1997 | Friel et al. | 451/177 |

FOREIGN PATENT DOCUMENTS

| | | |
|---|---|---|
| 232889 | 4/1964 | Austria . |
| 2310835 | 10/1976 | France . |
| 957475 | 5/1964 | United Kingdom . |
| 961090 | 6/1964 | United Kingdom . |
| 1233340 | 5/1971 | United Kingdom . |
| 2186512A | 8/1987 | United Kingdom . |
| 2248568A | 4/1992 | United Kingdom . |
| 2252744A | 8/1992 | United Kingdom . |
| 2283929A | 5/1995 | United Kingdom . |
| WO 95/16545 | 6/1995 | WIPO . |
| WO 95/23672 | 9/1995 | WIPO . |

*Primary Examiner*—Timothy V. Eley
*Assistant Examiner*—Dung Van Nguyen
*Attorney, Agent, or Firm*—Michaelson & Wallace; Peter L. Michaelson

[57] ABSTRACT

An implement working adapter has a casing within which is a pulley-drive system for transferring drive from a powered grinding tool, with which the adapter is engaged, in use, to a pair of first and second grinding wheels within the casing, drive being transmitted via a drive belt engaged, in use, by a take-off pulley of the tool drive. The adapter defines three implement working locations for sharpening scissor blades, knives and screwdriver blades respectively, each location providing one or more slots for blade insertion. An angularly movable scissor guide has a slot for an inserted scissor blade to engage the first grinding wheel, whilst the slots for reception of the knife blades allow engagement with either grinding wheel as selected. The screwdriver blade engages the second grinding wheel when being sharpened, in use.

22 Claims, 3 Drawing Sheets

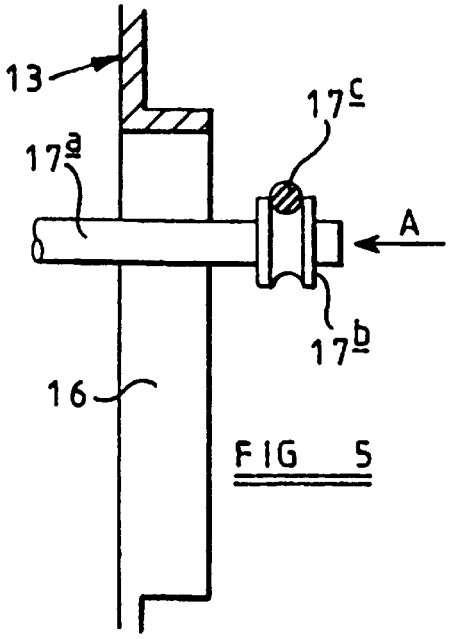
FIG 5
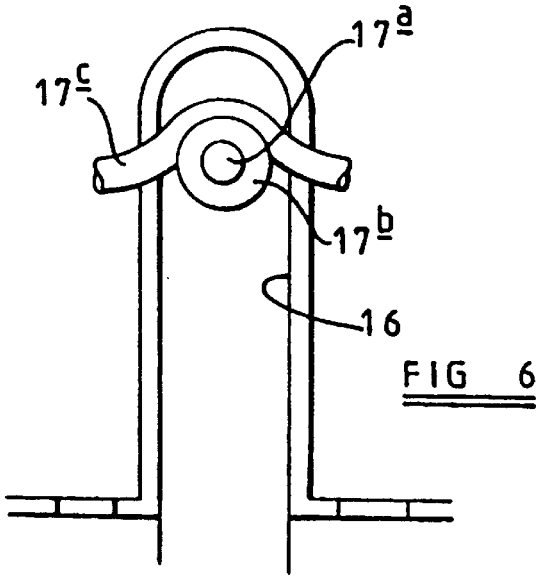
FIG 6
FIG 7
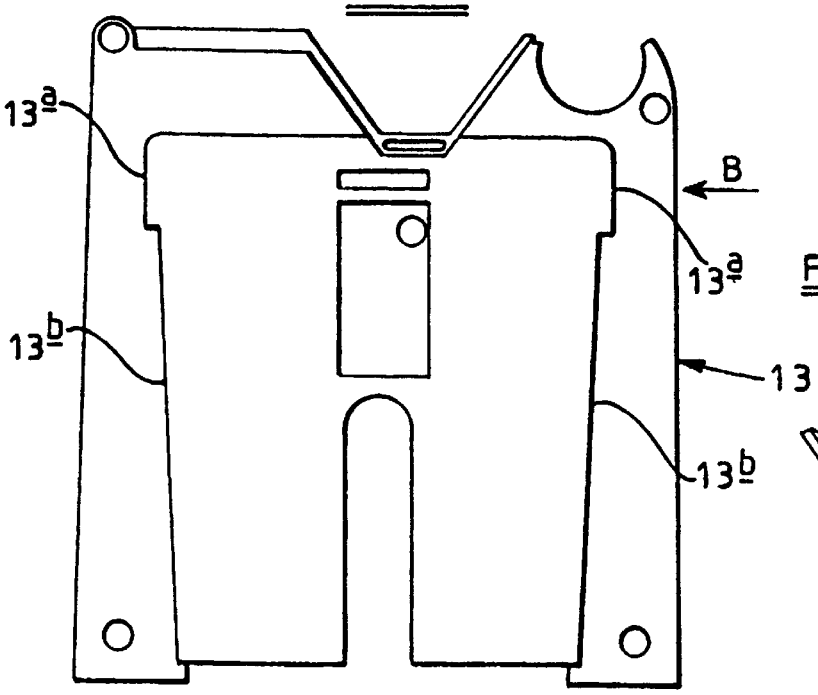
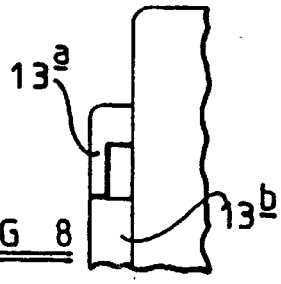
FIG 8
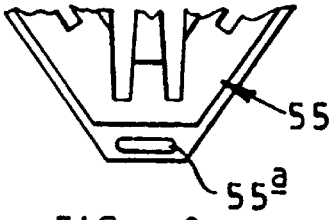
FIG 9

IMPLEMENT WORKING ADAPTER

BACKGROUND OF THE INVENTION

1. Field of the Invention

This invention relates to an adapter which is intended to be fitted to drive means, particularly of a powered grinding tool. By the use of selected ones of different such adapters, with the tool, the sharpening, smoothing, cutting, abrading, honing, etc. of implements, such as drill bits, scissors, knives, chisels, planar blades and the like can be effected.

2. Description of the Prior Art

A prior art grinding tool is described and claimed in our UK Patent No 2263424B, and different forms of adapters for use therewith are described and claimed in our UK Patents Nos 2283444B and 2283929B. With this prior art arrangement, the implement is worked at a grinding wheel of the tool, which is received within the selected adapter when it is fitted to the tool, in use.

SUMMARY OF THE INVENTION

An object of the invention is to provide an implement working adapter in a convenient form.

According to the present invention, there is provided an adapter for releasable engagement with drive means, the adapter comprising a rotatable grinding wheel drivable from the drive means, in use, and defining a location at which part of an implement can be received, in use, to be worked by the grinding wheel.

Preferably two locations are defined, with one location being a slot for receiving a scissors blade and desirably the other location being a slot for receiving a knife blade. Conveniently, the slot for receiving the scissors blade is in an angularly movable member, so that the angle of sharpening of the scissors blade by one grinding wheel associated with the member can be varied by angularly moving the member. Advantageously, the other location defines two different slots for reception of different knife blades respectively, one for domestic knives and the other for finer edges, each type of blade being sharpened, in use, by another grinding wheel associated with the other location. The adapter can also have a further location in the form of a screwdriver slot for sharpening a screwdriver blade by one of the grinding wheels, preferably the one used for sharpening the knife blades.

The invention also relates to a powered grinding tool which incorporates the features of the adapter of the invention as an integral part thereof, rather than being provided by a removable adapter.

BRIEF DESCRIPTION OF THE DRAWINGS

The invention will now be described, by way of example, with reference to the accompanying drawings, in which:

FIG. 5 is a scrap section through a rear moulding of the adapter showing how a drive belt of the adapter receives drive, in use, from a driven pulley of the powered grinding tool;

FIG. 6 is a scrap view on arrow A of FIG. 5;

FIG. 7 is a rear view of the adapter showing means for releasably connecting it to the powered grinding tool;

FIG. 8 is a scrap view on arrow B of FIG. 7; and

FIG. 9 is a scrap view of an inside part of a guide of the adapter.

DETAILED DESCRIPTION

Figure 1:
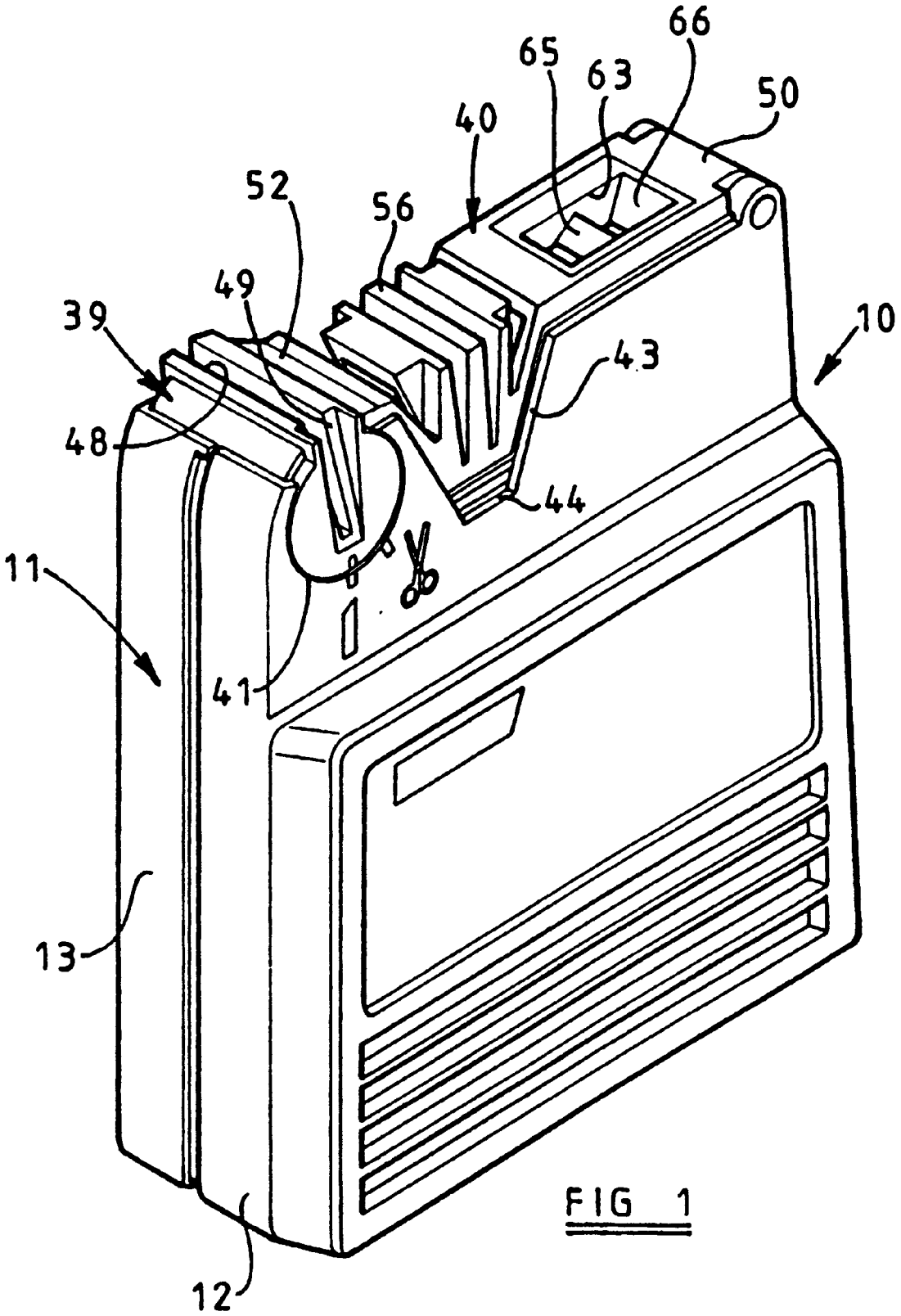
FIG. 1 is a front perspective view of an adapter of the invention, with means for removably fitting it to a powered grinding tool not being shown.

FIG. 1 shows an implement working adapter which is intended for use with the powered grinding tool generally of the form described and claimed in our UK Patent Application No 2263424B, but modified to provide power take-off to the adapter. This adapter differs from the prior art referred to in the introduction to this specification, in that it does not use the grinding wheel of the powered grinding tool to work an implement, but merely takes drive therefrom as will hereinafter be described, with particular reference to FIGS. 5 and 6.

Figure 2:
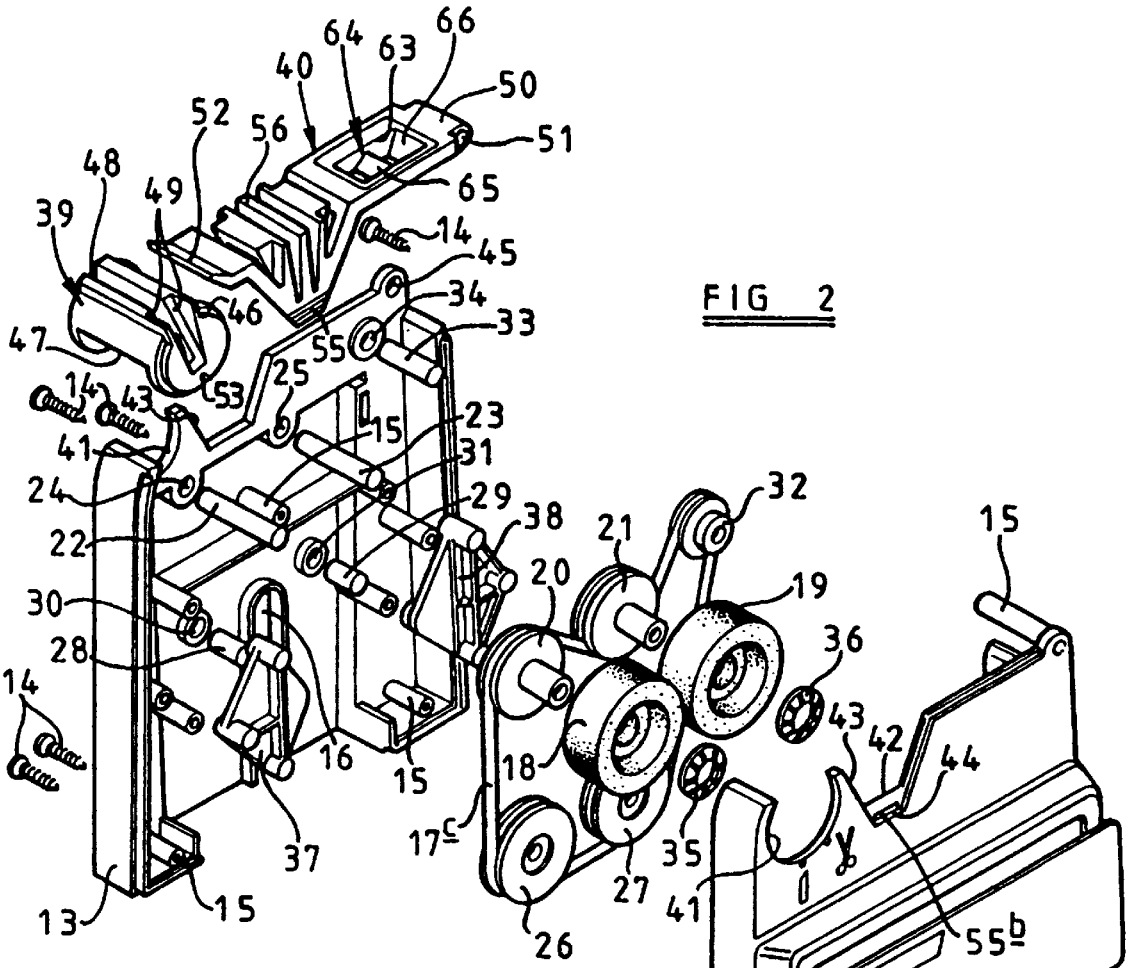
FIG. 2 is an exploded, schematic perspective view of the adapter of FIG. 1.

As shown in FIGS. 1 and 2, the adapter 10 is formed with a casing 11 made up of a front molding 12 and a rear molding 13. The two halves of the casing formed by the moldings 12 and 13 can conveniently be secured together by means of screws 14 engaging with interior bosses 15 formed on the inside of one or both of the moldings.

The rear molding 13 is formed with means for releasably connecting it at the front, working face of the powered grinding tool referred to above. The form of engagement can be as with the other adapters shown in our Patent No. 2263424B, or as in our PCT application No. PCT/6895/00447, or alternatively any other suitable engagement means can be provided. Normally, the adapter 10 would be engaged with the powered tool by sliding it down onto the front face, with some form of latching automatically taking place to secure the adapter in its correct position to take drive from the powered grinding tool, as will be described herein below. FIG. 7 shows the adapter with means substantially the same as with the adapter of our abovementioned PCT application, having ears 13*a,* and sloping side surfaces 13*b,* for slidably engaging the adapter with a powered grinding tool casing of the form shown in said PCT application.

As can be seen from FIG. 2, a parallel-sided opening 16 extends centrally upwardly from the bottom of the rear molding 13, the opening terminating approximately half way up the rear face of the molding 13. As will be explained, this opening 16 is to allow reception of a drive spindle 17*a* (shown in FIG. 5) of the powered grinding tool when the adapter 10 is fitted to the grinding tool, in use. A take-off pulley 17*b* or equivalent drive transmitting component on the drive spindle engages with and tensions a spring drive belt 17*c,* in use, inside the casing, when the adapter is correctly fitted to the powered grinding tool. One form of such an arrangement is schematically shown in FIGS. 5 and 6, for a circular drive belt.

As can be seen from FIG. 2, the drive belt 17*c* is part of a pulley-drive system for transferring drive from the take-off pulley to a pair of grinding wheels 18, 19 respectively within the adapter. The wheels 18, 19 are disposed side-by-side, being carried on respective pulley arbors 20, 21 which are peripherally grooved to receive the belt 17*c,* the belt engaging the upper periphery of arbor 20 and the lower periphery of arbor 21 so that these rotate in opposite directions. The arbors 20, 21 are rotatably carried on respective arbor pulley shafts 22, 23 which are fixedly received in respective blind bores 24, 25 in the inner surface of the rear molding.

Below the pulley arbors 20, 21, the drive belt 17*c* engages grooved idler pulleys 26, 27 respectively, these pulleys being rotatably mounted on idler pulley shafts 28, 29 respectively fixedly received in blind bores 30, 31 respectively in the interior surface of the rear molding 13. Completing the pulley-drive system, is a small pulley 32 which is engaged by the drive belt 17*c* between the arbor 21 and idler pulley 27. The pulley 32 is rotatably mounted on a shaft 33 fixedly received in a blind bore 34 in the interior surface of the rear molding. As shown in FIG. 2, the shaft 33 is at a level slightly above the arbor pulley shafts 22, 23. FIG. 2 also shows respective retaining washers 35, 36 to secure the grinding wheels on their respective arbor pulley shafts, and respective pulley brackets 37, 38, each carried on three spigots. Each bracket extends over part of the front of its associated pulley and holds the pulley in place. Each bracket can have a rearwardly directed spigot extending through the centre of its associated pulley.

It will thus be appreciated that with this pulley-drive system, drive is transmitted, in use, from the powered grinding tool drive shaft 17*a* via the take-off pulley 17*b* in engagement with the drive belt 17*c*, the tensioned drive belt then transmitting drive by friction to the arbors 20, 21 and thus to the grinding wheels which rotate together in opposite directions to allow sharpening of implements as will be described.

FIG. 2 shows that the top of each of the moldings 12, 13 is open, so that when the two moldings are fitted together to form the casing, a continuous aperture is formed in the top thereof. Received in this aperture is a scissor guide 39 (also referred to herein as a "locator element") and a knife and screwdriver guide 40, both of plastics material.

The upper surface of the front face of the front molding, and the upper surface of the rear face of the rear molding are configurated identically to provide at the upper left hand side, as viewed in FIG. 2, a partly circular opening 41. Next to this opening 41 approximately at the center of the face is an opening 42 which has straight, downwardly converging sides 43 with a flat base 44 slightly below the innermost level of the opening 41. The remainder of the upper surface of each face is flat, extending at the same height as the left hand side wall of each molding half. The right hand side wall of each molding is slightly cut away as shown in FIG. 2, with the corner of the adjacent face being provided with fixing means for securing the moldings together, in the form of a internally threaded boss 15 extending rearwardly from the inner surface of the front molding 12, together with a circular hole 45 through the rear face of the rear molding 13 in alignment with the boss for reception of a screw 14.

The scissor guide 39 is generally cylindrical, having a length substantially equal to the width of the casing. However at its front and rear ends it is annularly cut away around its periphery so that the ends are effectively formed as short cylinders 46 which are received by the internal part-circular bearing surfaces of the openings 41 in the front and rear moldings. In this way the scissor guide is thus rotationally carried by the casing with its axis parallel to the axis of each grinding wheel. Substantially the whole length of the scissor guide between its bearings 46 is cut away at its underside, and breaking into this relieved part 47 is a generally radial slot 48 which extends through the whole length of the guide 39 inwards from its upper radially outwardly extended peripheral surface. The slot 48 is generally rectangular, but with slightly inwardly sloping sides. At the front of the slot 48, its respective opposite side faces 49 are sloped rearwardly from the slot base, to define clearance rebates.

Figure 3:
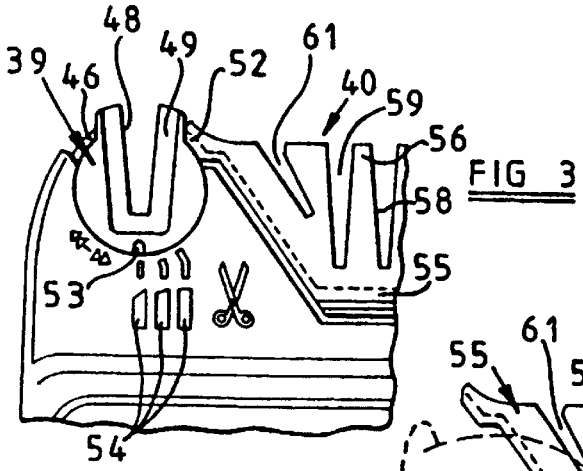
FIG. 3 is an enlarged, fragmentary front view of part of the adapter.

The remainder of the aperture formed in the top of the casing when the moldings 12 and 13 are assembled together, is filled by the knife and screwdriver guide 40. The guide 40 can have a width such that its undersurfaces rest on the previously described configurated top surfaces of the moldings 12 and 13 respectively, for example as shown in FIG. 1 for the engagement of the guide on the top edge surfaces of the molding 12. At its right hand end, the molding is formed with a lug 50 which is received between the main faces respectively of the moldings 12, 13, a circular bore extending through the lug so that it can receive the boss 15 which passes therethrough into the hole 45. Accordingly by means of the screw 14 passing through the hole 45 and engaging with the boss 15, the lug 50, and thus the guide 40, is pivotally connected to the casing. In use it is secured in place, by a snap-fit remote from its non-pivoted end, in the top of the casing as shown best in FIG. 1. In this position an end part 52 of the guide 40 engages the part-cylindrical periphery of the guide 39 at the right hand side thereof, the engaging face of the part 52 being of matching concave form, so as to provide smooth engagement. As previously mentioned, the guide 39 is rotatable in the casing, and FIG. 3 shows that, due to the engagement of the part 52, this rotation takes place in an anti-clockwise direction from the position shown in FIGS. 1 and 3, being limited by guide 39 engaging the side of the casing. It can be seen from FIG. 3 that a reference marked 53 at the bottom of the guide can be aligned with a corresponding reference angle 54 on an adjacent part of the front surface of the molding 12, there being three reference angles indicated corresponding to various degrees of rotation of the guide 39 for different scissor bevels.

Next to the part 52, the guide 40 has a downwardly depending part 55 which is exteriorly shaped to match the shape of the openings 42. Respective spaced opposite inside surfaces at the bottom of part 55 have projections 55*a* (see FIG. 9) to enable the guide 40 to engage as a snap-fit with the casing in its downwardly pivoted FIG. 1 position, with the projections 55*a* engaging recesses 55*b* each in a casing molding at a position just above just above the base 44. In the top of the part 55 are four slots arranged symmetrically about a central upstanding wall 56 which has respective downwardly sloping opposite sides 57, 58. A first pair of slots 59, 60 respectively is formed directly adjacent the wall 56, with the side 57 forming one side of the slot 59, and the side 58 forming one side of the slot 60, the slots 59, 60 being generally vertical, in normal adapter use. Symmetrically disposed outside of the slots 59, 60 are the second pair of slots 61, 62 respectively, these being less deep than the first pair of slots and being angled downwardly and inwardly towards the slots 59, 60. The lower parts of respective outer side surfaces of the downwardly depending part 55 are cut away, as best represented in FIG. 4, to receive the grinding wheels 18, 19 so that, as will be described, knife blades received in any of the slots 59 to 62 inclusive can be engaged by one or other of the grinding wheels, the slots communicating with the space in which the grinding wheels are disposed.

Between the part 55 and the lug 50, the guide 40 is formed with a rectangular opening 63 which extends from the top to the bottom of this part of the guide. Between opposite longer side walls of the opening, and positioned below the top of the guide 40 is a central location element 64, with a top surface 65 sloping downwards in a direction away from the lug 50. The surface 65 terminates short of the adjacent end of opening 63, to define a slot. At the other end of the opening, i.e. that adjacent lug 50, a steeper, downwardly sloping surface 66 is provided, the surface terminating short of element 64, to define a further slot. The surface 66 is enclosed by depending opposite sides of the opening 63, one side 67 being shown in FIG. 4.

Figure 4:
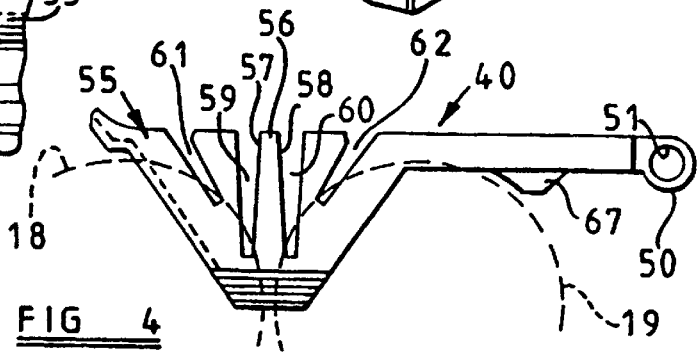
FIG. 4 is a front view of a knife blade and screwdriver blade sharpening part of the adapter.

As also shown in FIG. 4, the grinding wheel 19 lies adjacent the bottom of the opening 63 at one side thereof and, in use, the grinding wheel can be used in conjunction with the opening 63 to sharpen a screwdriver blade inserted into the opening 63 and engaged on surface 65 or surface 66. In order to grind the end of the screwdriver blade, the blade is laid on surface 66 and moved down so that its end comes into engagement with the wheel 19, whereby it is ground. In order to grind the sides of the blade adjacent the end, the blade is instead laid on surface 65 and moved down so that one such side comes into engagement with the wheel 19, whereby it is ground. The blade is then turned over to grind the opposite side in the same manner.

From the above description, taken in conjunction with FIGS. 3 and 4, it will be understood that the grinding wheel 18 is disposed so as to register with scissor blades inserted into slot 48 of the scissor guide 39. When correctly positioned in the guide, the scissor blade will be sharpened upon driven rotation of the grinding wheel 18, in use. As described, the position of the guide 39 can be rotationally adjusted for different scissor blade bevels.

The slots 59 to 62 can be used to sharpen knife blades. The inner slots 59, 60 are for sharpening, for example, blades of domestic knives, which require a standard angle, while the outer slots are for sharpening the blades of knives having finer edges, i.e. which require a sharper angle. It will be clear from FIG. 4 that the slots 59 and 61 are used for sharpening with the wheel 18, while the other two slots are for sharpening with the wheel 19.

It will be appreciated that instead of providing two grinding wheels, only a single wheel could be provided, or alternatively more than two could be provided. Correspondingly, the number and form of sharpening stations could also be altered from that shown. For example, the screwdriver slot could be omitted. Moreover, instead of the arrangement described where each wheel is effective at two sharpening stations, each wheel could be associated with one sharpening station only, or with more than two.

Although the invention primarily relates to an adapter for fitting at a powered tool, it will be appreciated that alternatively the powered tool and adapter could be formed as one part, i.e. where the adapter is, in effect, fixed to the tool. In this case, the or each grinding wheel may be directly driven from the motor or it may still be driven by means of a take-off pulley using the drive belt. In either arrangement, the powered tool may or may not have an additional large grinding wheel, so that any take-off pulley may or may not be driven from a main grinding wheel shaft. This is also the case with the adapter, where the powered tool may or may not have a large main grinding wheel. It would be possible for the powered grinding tool merely to provide drive which can be taken off and used with a number of different adapters such as the adapter 10, each adapter, for example, having its own means of sharpening, smoothing, cutting, abrading, honing, etc. Although in this embodiment the slots for the knife blades are at fixed angles, these could be on an element which is adjustable to alter these angles, and this could apply to all implement locations.

What is claimed is:

1. An adapter for releasable engagement with drive means, the adapter comprising a rotatable grinding wheel drivable from said drive means, in use, an axis of rotation of the grinding wheel, a locator element, a location defined by the locator element at which a part of an implement, said part having an edge or blade, can be received, in use, wherein said part is to be worked by said grinding wheel, an axis of rotation of the locator element, the axis of rotation of the locator element being parallel to the axis of rotation of the grinding wheel, the locator element being angularly movable about its axis of rotation relative to the grinding wheel to alter an angle of working of said part of the implement, and a slot in the locator element into which slot said part of the implement is inserted, in use, for engagement with, and thus working by, said grinding wheel.

2. An adapter as claimed in claim 1, wherein the slot extends generally radially through the locator element.

3. An adapter as claimed in claim 1, wherein opposite, spaced parallel sides of a casing of the adapter define respective bearing surfaces engaged by respective opposite end portions of the locator element.

4. An adapter as claimed in claim 3, wherein said locator element is of generally cylindrical form having a lower part of its periphery open between said end portions to receive part of said grinding wheel, said slot extending inwardly from an upper part of the periphery of the locator element into communication with said open lower part thereby allowing said part of the implement inserted into said slot, in use, to engage the grinding wheel.

5. An adapter as claimed in claim 3, wherein indication means on the locator element can be aligned with a selected one of a plurality of indication means on the casing to place the locator element at a selected angular position relative to the grinding wheel.

6. An adapter as claimed in claim 1, wherein said angular movement of the locator element is limited in opposite directions by its engagement with respective stop surfaces.

7. An adapter as claimed in claim 6, wherein one stop surface is formed by part of said casing of the adapter.

8. An adapter as claimed in claim 7, wherein the other stop surface is formed by a part of a guide providing a further implement working location.

9. An adapter as claimed in claim 8, wherein said further location is provided by guide slot means spaced from said locator element slot, the guide slot means allowing said part of an implement inserted into it, in use, to engage said grinding wheel.

10. An adapter as claimed in claim 9, wherein the guide slot means is formed in said guide, which guide is spaced along a top of the casing from said locator element.

11. An adapter as claimed in claim 10, wherein the guide is pivotally mounted on the casing and snap-fittingly held in engagement therewith.

12. An adapter as claimed in claim 9, wherein the guide slot means comprises at least two slots at respective different fixed angles to said grinding wheel.

13. An adapter as claimed in claim 9, wherein the guide slot means comprises at least one slot allowing engagement of said part of the implement with said grinding wheel, and at least another slot which allows engagement of said part of the implement with another grinding wheel of the adapter, drivable, in use, from said drive means in an opposite direction to said one grinding wheel.

14. An adapter as claimed in claim 9, wherein a still further location is defined by an opening in the guide, at a position spaced from said guide slot means, the opening defining a first angled surface for receiving said implement with an end portion of said part of the implement in engagement with another grinding wheel.

15. An adapter as claimed in claim 14, wherein said opening defines a second angled surface, at a different angle from said first angled surface, for supporting said implement during engagement of the end portion with said another grinding wheel.

16. An adapter as claimed in claim 14, wherein the grinding wheel and said another grinding wheel are arranged to be driven, in use, in opposite directions.

17. An adapter as claimed in claim 16, comprising a drive belt engageable, in use, by take-off means of the drive means, to transmit drive, in use, to said grinding wheels.

18. An adapter as claimed in claim 17, wherein the drive belt engages respective pulley means, carrying the grinding wheels and also idler pulleys, the pulley means and the idler pulleys being carried on respective shafts extending from the casing of the adapter.

19. An adapter as claimed in claim 17, wherein the take-off means is a take-off pulley which engages the drive belt, in use, a drive shaft of the drive means carrying said take-off pulley and extending into the interior of the casing of the adapter through a slot in a rear part thereof, in use.

20. An adapter as claimed in claim 8, wherein the guide provides a still further location allowing engagement of said part of the implement with a further grinding wheel of the adapter.

21. A powered grinding tool comprising drive means, a rotatable grinding wheel driven from said drive means, in use, an axis of rotation of the grinding wheel, a locator element, a location defined by the locator element at which a part of an implement, said part having an edge or blade, can be received, in use, wherein said part is to be worked by said grinding wheel, an axis of rotation of the locator element, the axis of rotation of the locator element being parallel to the axis of rotation of the grinding wheel, the locator element being angularly movable about its axis of rotation relative to the grinding wheel to alter an angle of working of said part of the implement, and a slot in the locator element into which slot said part of the implement is inserted, in use, for engagement with, and thus working by, said grinding wheel.

22. A powered grinding tool as claimed in claim 21, comprising two rotatable grinding wheels driven from said drive means, and respective implement working locations associated with said grinding wheels, so that, in use, respective parts of two implements, each of said respective parts having a corresponding edge or blade, received at said working locations respectively can be worked by the grinding wheels thereat.

* * * * *